US008651933B2

(12) United States Patent
Werkstell

(10) Patent No.: US 8,651,933 B2
(45) Date of Patent: Feb. 18, 2014

(54) SYSTEM FOR PLAYING A GAME OF SKILL

(71) Applicant: Gadi Werkstell, Tel Aviv (IL)

(72) Inventor: Gadi Werkstell, Tel Aviv (IL)

( * ) Notice: Subject to any disclaimer, the term of this patent is extended or adjusted under 35 U.S.C. 154(b) by 0 days.

(21) Appl. No.: 13/755,777

(22) Filed: Jan. 31, 2013

(65) Prior Publication Data

US 2013/0137497 A1 May 30, 2013

Related U.S. Application Data

(63) Continuation-in-part of application No. 11/585,983, filed on Oct. 25, 2006, now abandoned.

(51) Int. Cl.
*A63F 9/24* (2006.01)

(52) U.S. Cl.
USPC ..... 463/13; 463/7; 463/23

(58) Field of Classification Search
USPC ..... 463/13
See application file for complete search history.

(56) References Cited

U.S. PATENT DOCUMENTS 4,948,134 A 8/1990 Suttle et al.
5,823,879 A 10/1998 Goldberg et al.
6,004,205 A * 12/1999 Lauretta et al. ..... 463/11
6,142,872 A 11/2000 Walker et al.
6,193,607 B1 * 2/2001 Kay ..... 463/22
7,874,911 B2 * 1/2011 Walker et al. ..... 463/20
2002/0190469 A1 * 12/2002 Conklin et al. ..... 273/292
2005/0215326 A1 * 9/2005 Iosilevsky ..... 463/46
2006/0135240 A1 * 6/2006 Barshack ..... 463/13
2007/0072666 A1 3/2007 Loewenstein et al.
2007/0235936 A1 10/2007 Couri

FOREIGN PATENT DOCUMENTS

IL 2004022185 A2 3/2004
WO WO 2004022185 A1 * 3/2004

* cited by examiner

*Primary Examiner* — Tramar Harper
(74) *Attorney, Agent, or Firm* — Patwrite Law; Mark David Torche

(57) ABSTRACT

A system for playing a game of skill with rules fashioned on those of poker using one suit of a standard deck of playing cards. The system is adapted to allow a plurality of players to compete against one another. Each player is provided a screen with the same hand of face-up cards simultaneously. The cards in each hand are of the same suit. Each card is arranged within a circular configuration in sequential numerical and/or value order. The system deals each player a previously unknown and not predetermined initial set of cards as each other player and allows each player to change any one or more of his cards in sequential numeric/value order, up or down. Each single step up or down to change a card is considered a step and a predetermined total number of steps is allowed to attempt to achieve the best poker hand.

14 Claims, 3 Drawing Sheets

SYSTEM FOR PLAYING A GAME OF SKILL

CROSS REFERENCE TO RELATED APPLICATIONS

This application is a continuation in part of U.S. patent application Ser. No. 11/585,983 entitled GAME OF SKILL AND SYSTEM AND METHOD FOR PLAYING IT, filed on Oct. 25, 2006; the entire contents of which are incorporated herein by reference.

FIELD OF THE INVENTION

The present invention relates to a system providing a game of complete skill fashioned on the rules of poker for winning (achieving the best hand), particularly suited to playing using electronic venues such as the Internet, cell phones and the like.

BACKGROUND OF THE INVENTION

There are many games of skill and luck suited for playing on or via the Internet, for example chess, which is a game of skill, and card games, which typically involve a significant amount of luck. Poker is an example of such a card game, which is very popular and typically uses a standard deck of playing cards.

Numerous variations of poker type card games are also popular. Poker to a large extent relies on luck to win as players do not know what cards their opponents are holding and what cards are to be dealt next. A particular issue with such games is that in some locations playing games of luck for gambling purposes has been restricted.

WO 2004/022,185 (Werkstell) discloses an electronic machine arranged to allow a single person to improve poker playing. The machine includes a screen sized to allow the display of at least one array of 3 rows and 5 columns to display 15 playing cards face up; and a plurality of user controls allowing the player to move any card in the upper row of the array downwards and to move any card in the lower row upwards. The machine also includes a comparator and a calculation and screen display means for comparing the combination achieved by the player to the best combination possible using the displayed cards. The machine is programmed to demonstrate the correct moves to achieve the best or better possible combination if the player has failed to achieve said best combination. The machine can be programmed to limit the time of play and/or to limit the number of moves possible. The player could use a personal computer or a television with a remote control for playing.

U.S. Pat. No. 6,193,607 (Kay) discloses a random number generator for use with electronic devices. The generator is particularly useful in games of chance such as poker, roulette, and slot machines, where randomness is critically important to ensure proper payment of winnings.

U.S. Pat. No. 5,823,879 (Goldberg, et al.) discloses a network gaming system for automating games such as blackjack, poker, craps, roulette, baccarat and pai gow, wherein players may play continuously and asynchronously. The games do not require a manual dealer and the system may be used to play such games on the Internet or an interactive cable television network wherein a game controller communicates with players at network nodes in their homes.

U.S. Pat. No. 4,948,134 (Suttle, et al.) discloses an electronic poker game in which a player and a dealer are each dealt five cards. If the dealer has a poker hand having a value less than an Ace-King combination or better, the player automatically wins. If the dealer has a poker hand having a value of an Ace-King combination or better, then the higher of the player's or the dealer's hand wins. If the player wins, he receives a bonus payment depending on the poker rank of his hand. By making an additional wager, a player can also participate in a progressive jackpot component of the card game.

US 2007/072,666 (Loewenstein, et al.) discloses a multi-hand poker game where the cards are dealt in in a diamond pattern with four hands formed from five card groups. A player may swap cards among the four hands before the hands are compared to a pay-table.

U.S. Pat. No. 6,142,872 (Walker, et al.) discloses a method and apparatus for team play of slot machines for enabling team play by a plurality of slot machine players. The game results of each team player are combined in a predefined manner to obtain a team game result. The game results of each player may be combined on a "per-spin" basis, or collected for each team player over an entire play session. A session can be defined, for example, in terms of (i) the number of plays per session; (ii) the duration of the session; or (iii) all plays until a predefined event occurs.

US 2007/235,936 (Couri) discloses a method and apparatus for playing a poker game where one or more players can play against the house, using a standard fifty-two card deck. Players place their first bet after the cards have been dealt. All cards, twelve total, are dealt face-up exposing six 2-card hands.

OBJECTS OF THE INVENTION

It is an object of the present invention to provide a game, system and method for playing a card game of complete skill rather than luck that avoids the afore-mentioned issues.

It is a further object of the present invention that it is adapted for play using electronic venues. Examples of electronic venues include the Internet, computers, cell phones, PDAs and the like.

It is a further object of the present invention to provide a system and method for playing such a skill game whose rules for winning are fashioned on the rules of the card game poker; i.e. four of a kind beats a full house which beats three of a kind which beats two of a kind, and the like.

It is a further object of the present invention that such a system and method are adapted to allow competitive play of the skill card game between a plurality of players, as compared to play against a computer or machine or "house" dealer.

SUMMARY OF THE INVENTION

The present invention achieves the above-mentioned objects by providing a system for playing a game of skill whose rules for winning are fashioned on the rules of poker and uses one suit of a standard suit (from 2 to ace) of playing cards; in other words, 65 cards for the five-card hand). The system comprises a processor adapted (programmed) to allow a plurality of players to compete against one another wherein each player is provided a screen with the same hand (i.e. the exact same initial cards) of face-up cards at the same time. The cards in each hand are all of the same suit and each card of each hand is arranged within a circular configuration in sequential numerical and/or value order. The system (processor) is adapted to deal each player the exact same previously unknown and not predetermined initial set of cards.

The system (processor) is further adapted to allow each player to change any one or more of his cards in sequential numeric/value order, up or down (only). In other words, each of the players' cards can be changed to a card of one higher value or one lower value in a single step. For example a five can be exchanged for a four or a six in one step. If the player chooses six, and then wishes to continue changing that card, the player can only change to seven, or back to five. Cards are not discarded for a random unknown card, as in typical poker games. There is no luck, only skill, involved as each and every player knows what cards can, and will, be obtained. The skill is in the choosing of which cards to change, in which direction (up/down) and how many steps of change for each card—within the limits set by the rules, e.g. four total steps required. Each single step up or down to change a card is considered a step and the system allows (only) a predetermined total number of steps in order to attempt to achieve the best poker hand.

In accordance with another aspect, the invention provides a method for playing a game of skill comprising (a) accessing a system including a processor and a screen providing a game of skill on that screen, the game fashioned on the rules of poker and using one suit of a standard deck of playing cards arranged face-up and each card of each hand is arranged within a closed circle of cards configured in a circular sequential numerical/and value order and the system is adapted to deal each player a previously unknown and not predetermined initial set of cards as each other player and is further adapted to allow each player to exchange any one or more of his cards in sequential numeric/value order, up or down, utilizing a predetermined total number of exchanges; (b) receiving an initial poker hand; and (c) exchanging cards of the hand with the goal of achieving the optimal poker hand utilizing said predetermined total number of exchanges.

It should be understood that the game can be played with a series of numbers, e.g. 1 through 13, 1 through 10, etc.; or a series of symbols or pictures, and as such, in the specification and claims the term "cards" will be used in a broad sense to include such options. However, for simplicity of description, the term "cards" will be used exclusively.

Likewise, the term "poker hand" in the specification and claims should be considered to include game variations that may arise when using symbols or pictures and the like instead of a deck/suit of standard playing cards.

In light of the above features, in particular that the cards are of one suit, it should be understood that the phrase "fashioned on the rules of poker" includes at least the stipulation that the hand of "flush" (and its variations of "straight flush" and "royal flush") lacks meaning in regards to determining the best hands, as all hands are of the same suit.

Furthermore, as each card in the hand is arranged in a circular configuration or "wheel" (which may be a "virtual" wheel as the game is typically played at a computer screen or the like), the cards in the hand cannot be physically moved around as with regular cards held in one's hand (i.e. physically arranged). Thus additional options for a "straight" are available. For example, rules for the poker hand of a "straight" according to the present invention may be stipulated to be any one or combination of where the straight runs right to left, left to right, in either direction or as with a typical cards where the cards can be arranged.

In the latter example, obviously the cards are not physically arranged in order (e.g. 2, 3, 4, 5, 6), rather, the cards are present such that they could be arranged into a "straight". In other words, according to particular embodiments only a hand with sequential cards ascending from left to right (e.g. 2, 3, 4, 5, 6) might be considered a "straight". According to other embodiments such a hand would not be considered a "straight". According to yet another embodiment only a hand with cards shown in ascending order from right to left (e.g. 6, 5, 4, 3, 2) would be considered a "straight".

According to other embodiments, a hand with cards shown in non-sequential order, but which could be put in sequential order if only they could be arranged (e.g. 2, 3, 4, 6, 5) may be considered a "straight". Obviously the odds of achieving the different types of straights and the difficulty involved in achieving it are affected and need therefore be taken into account. In fact, the odds of achieving a "straight" wherein the cards are in sequential order from left to right (or, analogously from right to left; and even from either direction) are particularly low and should thus be given a very high place in the hierarchy of poker hands for the game of the present invention.

According to a particular embodiment, the total number of predetermined steps is any particular number of steps, and it has been borne out from trials that requiring either four, five or six steps tends to facilitate a game of reasonable challenge and fun.

According to another embodiment, the system may be, and typically is, adapted so that its programming sets a predetermined time constraint for each playing each hand, as compared to where the players have as much time as they wish and wherein, for example, the best hand is the one which achieves the best possible (optimal) hand in the quickest elapsed time.

According to still another embodiment, the system may be adapted so that the initial hand has at best two of a kind.

According to yet another embodiment, the system may be adapted wherein the players compete for a predetermined amount of money in each hand played and moreover that a manager of facilitator of the system receives a predetermined percentage of wagers, if any, or a given sum from/for each hand played.

According to still another embodiment, the system may be adapted so that more than one player is the winner and the top "n" hands are winning hands (and "n" is obviously greater than one in this embodiment) and play can commence when there are at least "n+1" players. It is envisioned that a game consisting of ten players, wherein the best or top five hands are winning hands tends to facilitate an interesting and fun game.

BRIEF DESCRIPTION OF THE DRAWINGS

The invention may be more clearly understood upon reading of the following detailed description of non-limiting exemplary embodiments thereof, with reference to the following drawings, in which.

DETAILED DESCRIPTION OF THE INVENTION

Figure 1:
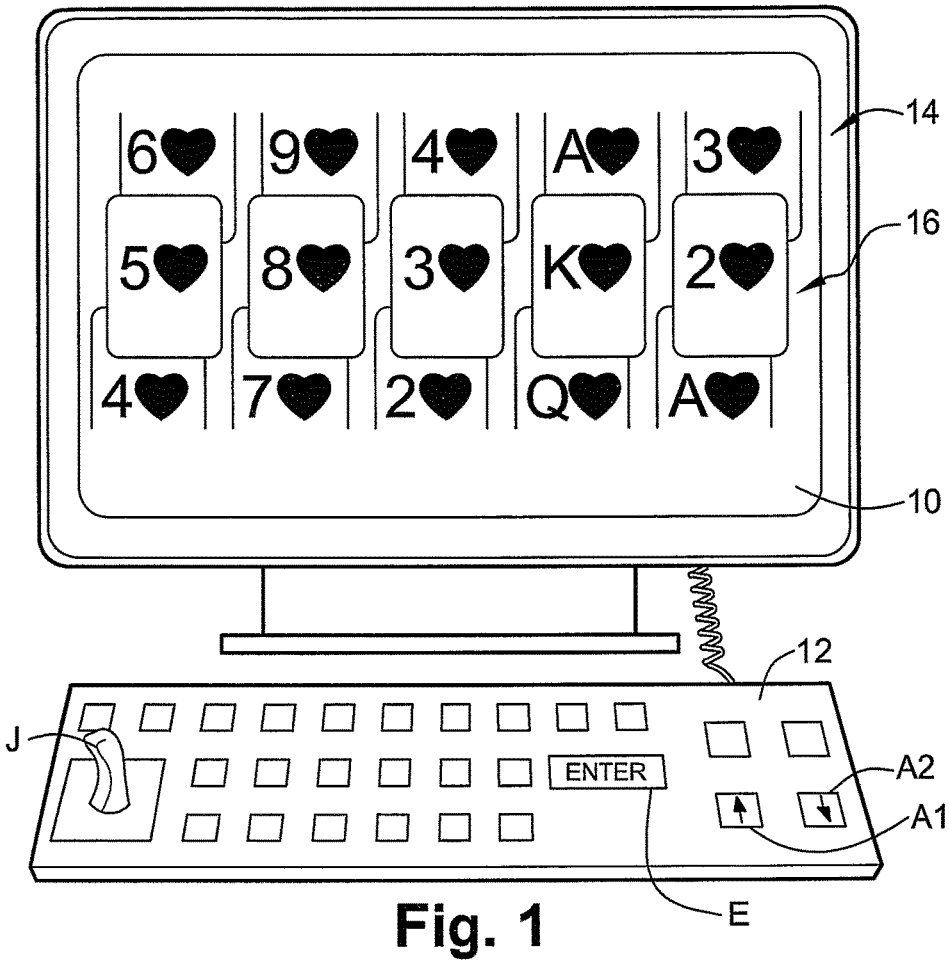
FIG. 1 is a front view of a computer screen and keyboard with an exemplary initial display produced by a system for playing a card game of skill via the Internet according to the present invention.

FIG. 1 shows a computer screen 10 and an input device 12, represented by a keyboard, with an exemplary initial display 14 produced by a system for playing a card game of pure skill. The game can be played via the Internet, wherein screen 10 and keyboard 12 typically resides in the home of a player or at an Internet cafe (not shown) or the like. Alternatively, screen 10 and keyboard 12 could be a device or part of a device, where a plurality of such devices are disposed at a one location so that all (or several) of the players are in the same proximity (e.g. at a gaming facility, FIG. 4); or a combination of the aforementioned. A wide variety of electronic venues are possible. Examples of additional alternatives for the display include where the screen 10 is part of a personal digital assistant, a cell phone and so on (all not shown).

Screen 10 shows an exemplary initial hand 16, a five-card hand (i.e. there are 65 cards used, 13 in each "wheel"). The hand shown comprises the following cards, all in the suit of hearts: 5, 8, 3, king and 2. Each card is one of thirteen cards in a suit of a standard deck of cards and is disposed in a closed circle, or "wheel" of cards in numerical sequence. Thus, just below the first card on the left, 5, is 4 (partially seen) and below that (unseen) is 3 and so on; and just above the 5 is 6 (partially seen), and so on. The other cards are analogously arranged/configured.

Figure 3:
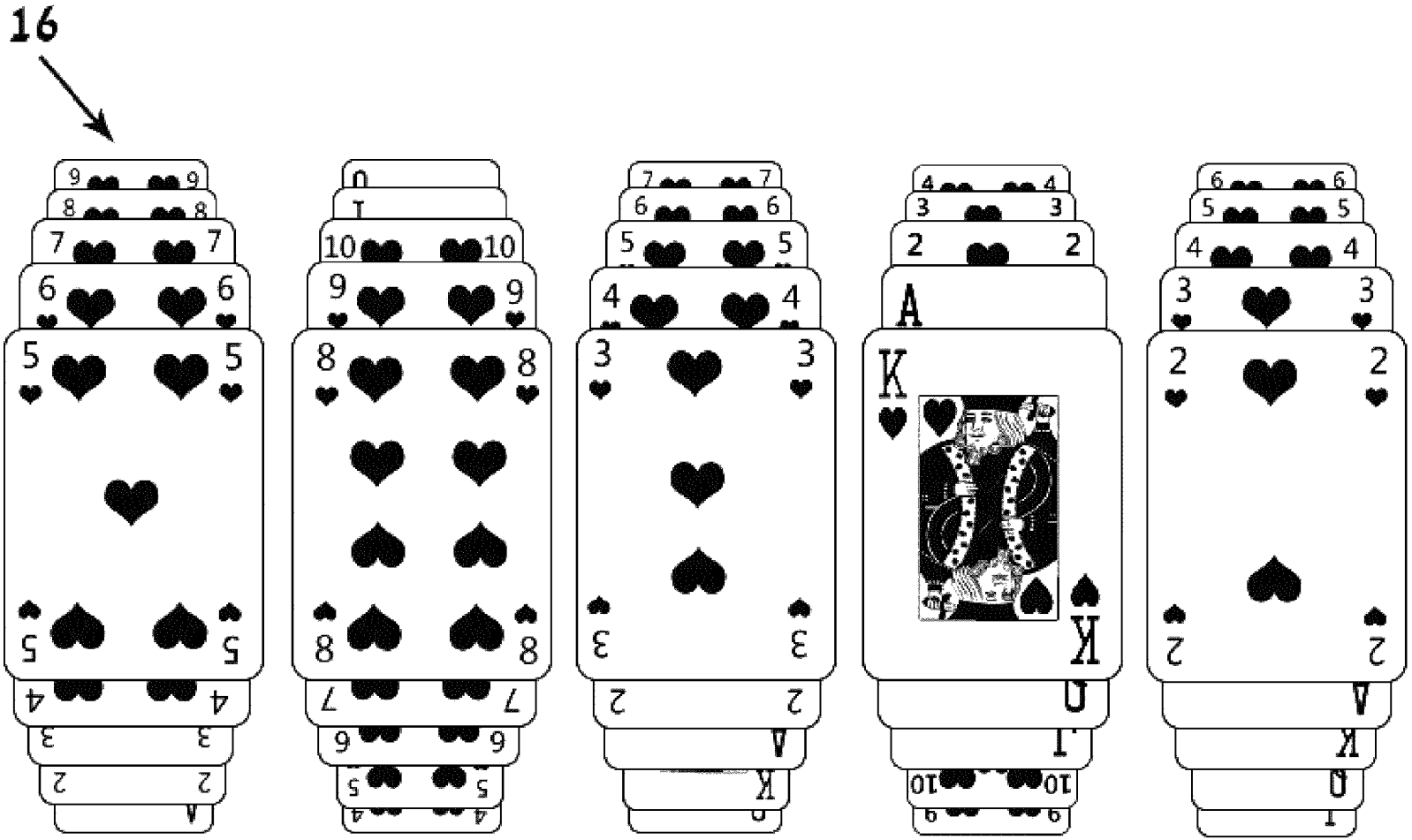
FIG. 3 shows a more detailed view of part of a "wheel" of cards shown in FIG. 1.

FIG. 3 better illustrates "wheels" of cards, where additional cards are shown with respect to FIG. 1. It should be understood that a complete (virtual) wheel of cards in accordance with the invention would be a complete set of the thirteen cards in a closed circle of cards.

Figure 4:
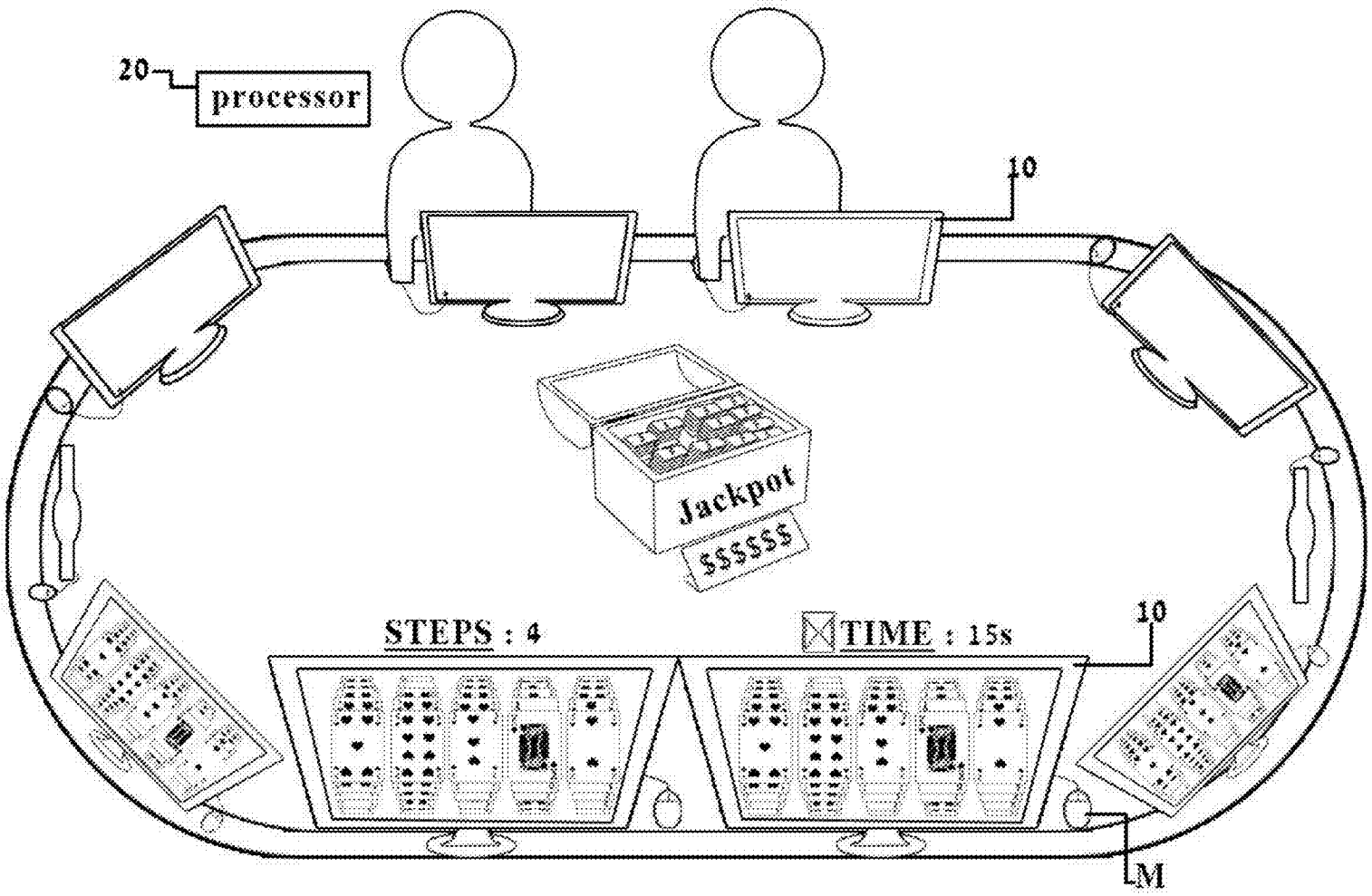
FIG. 4 shows the system at a gaming facility.

The object of the game is to move/change any or all of the cards, up or down in its "wheel" in order to achieve the best possible poker hand using (exactly; no fewer and no more than) a predetermined number of moves or steps, and typically within a predetermined amount of time. For the sake of explanation, it will be assumed that the system is programmed (via a processor 20; FIG. 4) so that four steps are to be used. One or more steps can be used to exchange, up or down, each of the cards in the hand. The exchange may be performed by a variety of means, for example, wherein the screen is a touch-screen (yet another example of input device 12), or wherein input device 12 allows a move or change of cards up and down, for example by using arrow keys A1 and A2, a joystick J or other such means for actuating a change of cards (e.g. a mouse M—FIG. 4); and to actuate suitable commands such as "start" and "finish", a key such as an "enter" key E may be used.

Figure 2:
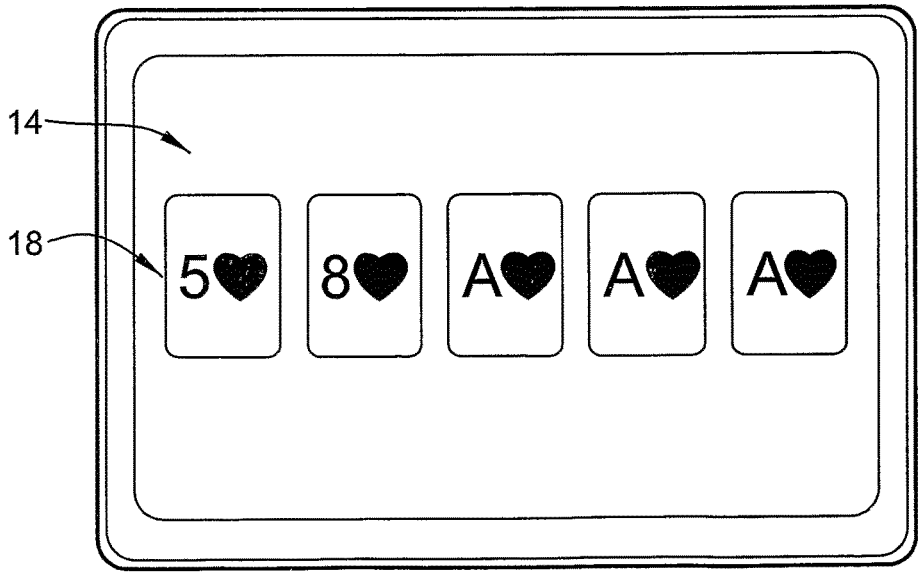
FIG. 2 shows a view of a display of the computer screen as in FIG. 1, however with an exemplary final hand, being an optimal hand under the stipulations of the game's rules.

In the present example, the best/optimal hand 18 (shown in FIG. 2) can be achieved by exchanging the third card from the left, initially a 3, downward for a 2 and then an ace (utilizing two steps); exchanging the fourth card from the left, initially a king, upward for an ace (utilizing one step); and exchanging the fifth card from the left, initially a 2, downward for an ace (utilizing one step). Thus, utilizing a total of four steps, a hand of three aces and 8 and a 5 is achieved. Through trial and/or inspection it can be determined that no better hand is achievable utilizing four steps and thus the optimal hand 18 has been achieved. In fact, if five steps were allowed, the best hand would still have three aces, and a 9 and a 5 (i.e. with the extra step it would be best to exchange the 8 for a 9). Thus, a player who used his four steps to change the cards in any other manner would not achieve as good a poker hand as shown in FIG. 2.

If for example ten players were competing, one manner of determining the winner may occur if only one of the players achieved the optimal hand 18 whereby only that player would be deemed the winner. If more than one player achieved such a hand, the winner could be deemed as the player who achieved the optimal hand in the shortest amount of time. According to another alternative, a predetermined number of players with the best hands could be deemed winners. According to yet another alternative, all players who achieve the optimal hand 18 could be deemed winners.

The winners could all receive a portion of wagers made, if any. In this regard, the system could be adapted (programmed) such a predetermined percentage of any wagers or a predetermined sum is deducted from the wagers, i.e. pool of possible winnings, and directed to a manager or facilitator of the system.

According to some embodiments, the system's programming (processor 20) imposes a predetermined time constraint for playing each hand. Alternatively, the system may allow the players to choose a time constraint, for example, among a list of times. In some embodiments, processor 20 is adapted to provide the initial hand 16 (as exemplified in FIG. 1) having at best the poker hand of two of a kind.

FIG. 4 schematically shows processor 20 of the system, which is operably connected to screen 10 and/or keyboard 12, and which is adapted to provide the game as described herein. Also seen are the exemplary game constraints of four steps and fifteen seconds.

It should be understood that there are various systems and methods for playing a game of skill that can be devised according to the present invention and that the above description is merely explanatory. Thus, the present system and method can be embodied in a variety of aspects falling within the scope of the present invention, mutatis mutandis.

What is claimed is:

1. A system for playing by a plurality of players a game of complete skill whose rules for winning are fashioned on the rules of poker, the system comprising:

a display screen for each respective player;

an input device operably and respectively connected to each display screen; and a processor operably connected to each display screen and configured to provide to the display screen of each respective player a same initial poker hand of previously unknown and not predetermined set of face-up cards of one suit each card in the hand from a standard deck of playing cards at the same time, each card of the set of cards arranged within a circular configuration in sequential numerical and/or value order of said one suit;

allow each player to change, via the input device, any one or more of the cards, in sequential numeric/value order only, up or down only, one or more times, each of the one or more times being a step; and allow a same predetermined and required total number of steps in order to attempt to achieve the best poker hand for each respective player, whereby the plurality of players can compete against one another for the best hand.

2. The system according to claim 1, wherein the processor is further configured to limit the amount of time the players are allotted in order to attempt to achieve the best poker hand.

3. The system according to claim 1, wherein the system configured so that the game can be played in a mode comprising one of: via the Internet; using a screen or machine for each player disposed at a gaming establishment; and a combination thereof.

4. The system according to claim 1, wherein the means to allow each player to change cards comprises one of a touch-screen means and a keyboard means.

5. The system according to claim 1, wherein the players place a predetermined wager for each hand played.

6. The system according to claim 5, wherein the system configured to deduct a predetermined percentage or sum from a total of the wagers and to direct that percentage or sum to a manager or facilitator of the system.

7. The system according to claim 1, wherein play can commence when there are at least "n+1" players and the best "n" hands are winning hands.

8. The system according to claim 7, wherein "n" is at least two.

9. The system according to claim 1, wherein the system is configured to allow ten players to play.

10. The system according to claim 1, wherein the total number of predetermined steps is at least four.

11. The system according to claim 1, wherein the poker hand having a straight is considered according to one of the following: the cards are in sequential ascending order from right to left; the cards are in sequential ascending order from left to right; the cards are in sequential ascending order from either right to left or left to right; the cards could be arranged to be in sequential order although they are not in order as they appear on the screen; and suitable combinations thereof.

12. The system according to claim 1, wherein the system imposes, or allows the players to choose, a playing time constraint for each hand.

13. The system according to claim 1, wherein half the players win and half the players lose.

14. The system according to claim 1, wherein the initial cards dealt comprises at best the poker hand of two of a kind.

* * * * *